US008596285B1

(12) United States Patent
Ramaprasad

(10) Patent No.: US 8,596,285 B1
(45) Date of Patent: Dec. 3, 2013

(54) ELECTROLYTIC SYSTEM AND METHOD FOR RESHAPING HAIR

(76) Inventor: Ram Ramaprasad, Princeton, NJ (US)

( * ) Notice: Subject to any disclaimer, the term of this patent is extended or adjusted under 35 U.S.C. 154(b) by 0 days.

(21) Appl. No.: 13/428,966

(22) Filed: Mar. 23, 2012

Related U.S. Application Data

(60) Provisional application No. 61/467,362, filed on Mar. 24, 2011.

(51) Int. Cl.
*A45D 7/00* (2006.01)
*A45D 6/06* (2006.01)

(52) U.S. Cl.
USPC ..... 132/210; 132/228

(58) Field of Classification Search
USPC ..... 132/202–210, 223–226, 229, 237; 219/227–229
See application file for complete search history.

(56) References Cited

U.S. PATENT DOCUMENTS 5,743,278 A 4/1998 Ookura et al.
6,881,928 B2 * 4/2005 Wong et al. ..... 219/222

* cited by examiner

*Primary Examiner* — Rachel Steitz
(74) *Attorney, Agent, or Firm* — LaMorte & Associates, P.C.

(57) ABSTRACT

A system and method of changing the shape of hair by breaking disulfide bridges in the keratin proteins of hair with atomic hydrogen. A hair setting structure is provided that contains at least one cathode and at least one anode. Hair is set into a predetermined shape. The hair is wet with the electrically conductive medium. Electrolysis is induced within the electrically conductive medium by flowing electrical current between cathodes and anodes. The electrolysis creates hydrogen. The hydrogen cleaves the disulfide bonds in the keratin proteins of the hair. After the disulfide bonds are broken, electrolysis is stopped and the hair is neutralized. The neutralization enables the disulfide bonds to reform, therein reshaping the hair into what is commonly referred to as a permanent wave.

17 Claims, 4 Drawing Sheets

ELECTROLYTIC SYSTEM AND METHOD FOR RESHAPING HAIR

RELATED APPLICATIONS

This application claims the benefit of provisional patent application No. 61/467,362, filed Mar. 24, 2011, entitled An Electrolytic Method For Reshaping Hair, the disclosure of which is herein incorporated by reference.

BACKGROUND OF THE INVENTION

1. Field of the Invention

In general, the present invention relates to systems and methods for reshaping hair either by adding curls or by removing curls from the hair. More particularly, the present invention relates to systems and methods that utilize the flow of electricity through or near human hair.

2. Background of the Invention

It is well known that different people have different types of hair. Hair comes in different colors and different degrees of fineness. Furthermore, it is easily observed that some people have straight hair while other people have curly or wavy hair.

For a variety of reasons, people with straight hair often endeavor to add body to their hair in the form of waves or curls. Conversely, many people with naturally curly hair endeavor to straighten their hair.

In the prior art, the body of a person's hair can be altered using either physical processes or chemical processes. The physical processes include the application of heat and/or water. Such physical processes include the use of hair dryers, curlers, hair irons and the like. Although such processes can curl or straighten hair, the effect is temporary. The effect is often lost the moment the hair gets wet or is exposed to high humidity conditions. Furthermore, the effects of the hair straightening or curling also fade with time. As such, the physically conditioned hair slowly returns to its natural condition, typically over the course of few hours to a few days depending upon hair type and ambient conditions.

Chemical processes change the body of hair by altering the chemical structure of the hair. Hair is made primarily of keratin proteins. The structure of keratin includes disulfide bridges. When hair is chemically treated, reducing chemicals, such as thioglycolic acid solution, are used to break the disulfide bridges of the hair protein. The hair is shaped as desired. The broken proteins are then reset using a neutralizing agent, such as hydrogen peroxide, that reforms the broken disulfide bridges. Since the chemical structure of the hair has been altered, the effect is called a "permanent" because the hair remains altered and is generally unaffected by subsequent washings.

The scission of the disulfide bridges in the keratin proteins takes place through the following steps. An equilibrium reaction occurs when a reducing agent, such as thioglycolic acid, encounters the disulfide bridge in the keratin structure. This reaction is represented by Equation 1 below where K denotes keratin, S are sulfides, S-S are disulfide bridges, H is hydrogen and R-SH is a reducing agent.

$$\text{K-S-S-K}+2\text{R-SH} \rightleftharpoons \text{R-S-S-R}+2\text{K-SH} \qquad \text{Equation (1)}$$

This equilibrium actually occurs through a two-step process. The first step is represented by Equation 2. The second step is represented by Equation 3.

$$\text{K-S-S-K}+\text{R-SH} \rightleftharpoons \text{K-S-S-R}+\text{K-SH} \qquad \text{Equation (2)}$$

$$\text{K-S-S-R}+\text{R-SH} \rightleftharpoons \text{R-S-S-R}+\text{K-SH} \qquad \text{Equation (3)}$$

The reaction is dependent upon the pH of the reducing agent and the time of hair exposure. Since the reducing chemicals being used are often highly alkaline or acidic, the reaction with the hair can be further influenced by the presence of an electrical current. The use of an electrical current in such a manner is exemplified in U.S. Pat. No. 5,743,278 to Ookura, entitled Method And Tool For Hair treatment.

Under conditions where the reactions of the above equations have proceeded enough, but not completely to destroy the hair, a considerable number of the disulfide bridges are severed. When the hair is neutralized, not all of the broken disulfide bridges reform and many disulfide bridges remain broken. This causes the strength of the hair to weaken significantly. Furthermore, the reducing chemicals used to break and reset the disulfide bonds are both caustic and foul smelling. The caustic nature of the chemicals can cause damage to the skin of the scalp and the follicles through which the hair grows. Accordingly, the health of the overall head of hair is further diminished.

A need therefore exists for a system and method that can cleave and repair disulfide bridges in the keratin proteins of hair, thereby creating a permanent change in hair shape without the use of any harsh reducing chemicals. A need further exists for a system and method that leaves fewer disulfide bridges unrepaired after the shape of the hair is altered. In this manner, both the strength of hair and the health of the scalp remain minimally affected. These needs are met by the present invention as described and claimed below.

SUMMARY OF THE INVENTION

The present invention is a system and method of changing the shape of hair by breaking disulfide bridges in the keratin proteins of hair with atomic hydrogen. In accordance with the present invention, an electrically conductive medium is provided that contains water. Furthermore, a hair setting structure is provided that contains at least one cathode and at least one anode. A lock of hair is set into a predetermined shape within the hair setting structure. As a result, at least some of the hair lays proximate to the cathodes. The hair is wet with the electrically conductive medium. Electrolysis is induced within the electrically conductive medium by flowing electrical current between the cathodes and anodes. The electrolysis creates hydrogen. The hydrogen cleaves the disulfide bonds in the keratin proteins of the hair. After the disulfide bonds are broken, electrolysis is stopped and the hair is treated with a neutralizing agent or the polarity of the cathodes and anodes are reversed to create a neutralizing reaction. The neutralization enables the disulfide bonds to reform. The hair therefore is reshaped to match the set shape of the hair in the hair setting structure. Using this technique, hair can be either curled or straightened. Since the change in the hair is chemical in nature, the effect is permanent and lasts as long as prior art chemical perm and chemical straightening techniques.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention system and method can be embodied in many ways, only a few embodiments have been selected for description. The selected embodiments are selected in order to set forth some of the best modes contemplated for the invention. The illustrated embodiments, however, are merely exemplary and should not be considered a limitation when interpreting the scope of the appended claims.

As has been previously discussed, when hair is chemically permed or chemically relaxed, harsh reducing chemicals are used to sever the disulfide bridges in the keratin proteins of the hair. The severing of the disulfide bonds is done through a chemical reaction with the reducing chemicals being used.

It has been discovered that the disulfide bridges in a keratin protein can be broken if brought into the presence of atomic hydrogen (H.). When in the presence of atomic hydrogen, the disulfide bridges sever, wherein the hydrogen atoms bond to the sulfur atoms to temporarily form -SH moiety.

The present invention creates atomic hydrogen in the presence of hair that is physically set into a selected shape. In this manner, the keratin -S-S- bridges within the hair are broken and the hair conforms to the selected shape. Naturally straight hair can be set into a curl or wave. Likewise, naturally curly hair can be straightened. The change to the hair is chemical in nature and therefore lasts just as long as a chemical permanent or a chemical hair-straightening treatment.

The atomic hydrogen needed to cleave the disulfide bridges within the keratin proteins is produced by electrolysis. During electrolysis, an electric current is passed through water between a cathode and an anode. The current causes the molecule of water to separate into oxygen gas and hydrogen gas. The hydrogen gas is produced about the cathode. During electrolysis, atomic hydrogen is initially produced. Pairs of hydrogen atoms quickly bond to form molecular hydrogen, i.e. hydrogen gas. However, a large volume of atomic hydrogen is available near the cathode to react with the keratin proteins of the hair.

Figure 1:
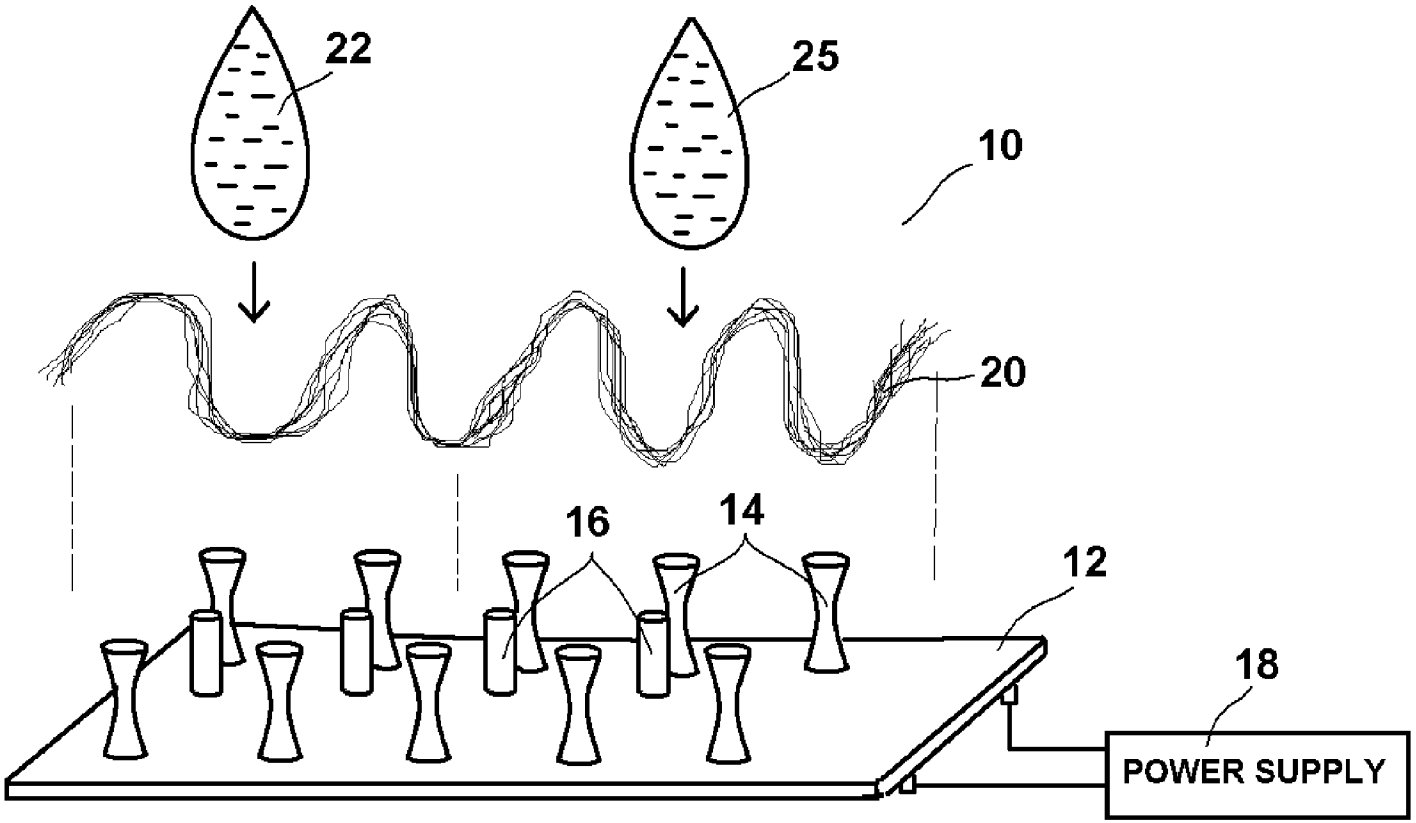
FIG. 1 shows an exemplary embodiment of the present invention hair setting system shown in conjunction with a lock of hair.

Referring to FIG. 1 an exemplary embodiment of a hair reshaping assembly 10 is shown. The hair reshaping assembly 10 includes a hair setting structure 12 upon which are located a plurality of cathode pegs 14 and a plurality of anode pegs 16. The cathode pegs 14 are electrically interconnected in parallel. Likewise the anode pegs 16 are electrically interconnected in parallel. Both the cathode pegs 12 and the anode pegs 16 are insulated from one another.

A DC power supply 18 is provided. The DC power supply 18 is connected to the cathode pegs 14 and the anode pegs 16, therein providing opposite electrical biases to the cathode pegs 14 and the anode pegs 16.

A lock of hair 20 is preset into the hair setting structure 12 by being woven around the cathode pegs 14 within the hair setting structure 12. As the hair 20 is woven around the cathode pegs 14, the hair 20 passes the anode pegs 16, which are positioned between the cathode pegs 14. This preset hair 20 in the hair setting structure 12 is then dipped, painted, plastered, or otherwise saturated with a buffered electrolyte 22. The buffered electrolyte 22 can be free-flowing liquid, but is preferably provided in the medium of a viscous gel. In this manner, the buffered electrolyte 22 will remain in contact with all the hair 20 within the hair setting structure 12 regardless of the orientation of the hair setting structure 12 with respect to gravity. If should also be understood that the hair 20 may be saturated with the buffered electrolyte 22 prior to the hair being preset within the hair setting structure 12. What is of importance is that the hair 20 is both preset within the hair setting structure 12 and is exposed to the buffered electrolyte 22.

When the DC power supply 18 is activated, electric current flows through the buffered electrolyte 22 between the anode pegs 16 and the cathode pegs 14. As current flows through the buffered electrolyte 22 an electrolysis reaction is induced within the buffered electrolyte 22. The result is that hydrogen is produced in the buffered electrolyte 22 in the areas immediately surrounding the cathode pegs 14. As hydrogen is produced, the preset hair 20 in the setting structure 12 near the cathode pegs 14 are exposed to atomic hydrogen created during electrolysis.

As preset hair 20 is exposed to atomic hydrogen, the atomic hydrogen bonds to the sulfur atoms on either side of the disulfide bridges, therein breaking the disulfide bridges. The physical shape of the keratin proteins is now amenable to reshaping. Since the preset hair 20 is physically formed around the cathode pegs 14, the hair 20 is shaped into this physical form. After a predetermined period of time has elapsed to ensure enough disulfide bond scission of the preset hair 20, the preset hair 20 is neutralized.

To neutralize the preset hair 20, the flow of current is stopped. This stops the electrolysis and thus the production of hydrogen. The preset hair 20 can then be dipped, sprayed, or otherwise saturated with a neutralizing agent 25, such as a dilute hydrogen peroxide. The hydrogen peroxide cleaves the hydrogen atoms from the sulfur atoms. This leaves the sulfur atoms free to combine and reform disulfide bridges within the keratin proteins as in the prior chemical route. The hair 20 is still physically preset in the hair setting structure 12. As the disulfide bridges reform, the hair 20 becomes chemically set into this new physical shape. Since the change in shape is caused by the resetting of disulfide bridges in the keratin proteins of the hair 20, the change in shape has the same degree of permanence as does a chemical perm. However, caustic reducing chemicals are never exposed to the hair 20 or to the scalp. Accordingly, no caustic and/or foul smelling chemicals need be used.

Furthermore, since there are no reducing agents used on the hair 20, no residual reducing chemicals remain that could inhibit the effectiveness of the neutralizing agent 25. The result is that less rinsing is necessary and the neutralizing agent is more effective. Consequently, a larger percentage of disulfide bridges are reformed and the hair 20 becomes stronger.

Neutralization can also produced without the use of any chemical neutralization chemicals at all. During electrolysis, hydrogen is produced in the areas surrounding the cathodes. By reversing the charge of the cathodes pegs 14 and the anode pegs 16, the electrolysis reaction can be reversed. This produces the hydrogen atoms away from the -SH moiety and leaves the disulfide bridges ready to reform. Since the current has been reversed, what was a cathode in the previous step is now the anode where oxidation ("neutralization step") takes place and the hair proximate to it will have much of the -SH groups recombine to form the disulfide bond. As such, it should be understood that hair 20 set by the electrolysis reaction can be neutralized by simply reversing the charge of the cathode pegs 14 and the anode pegs 16 for a short time.

Figure 2:
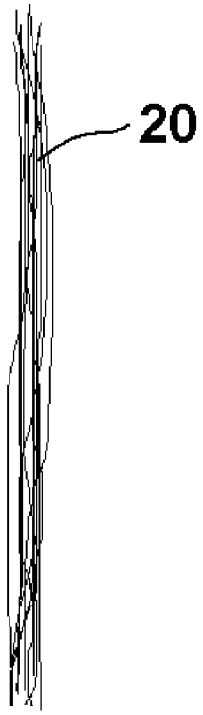
FIG. 2 shows the lock of hair of FIG. 1 prior to treatment.
Figure 3:
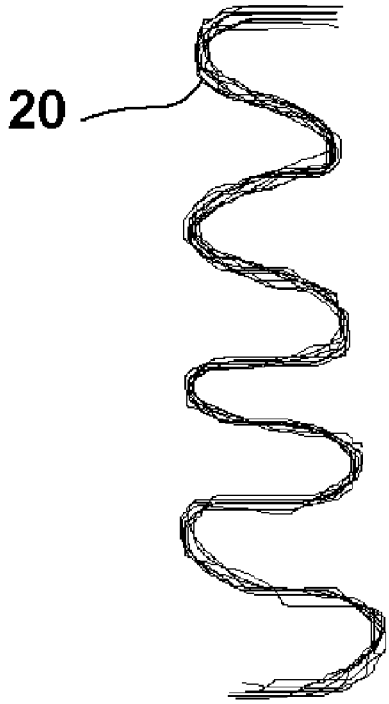
FIG. 3 shows the lock of hair of FIG. 1 after treatment.

FIG. 1 is one embodiment of the hair setting structure 12 where the positions of the cathode pegs 14 are designed to add waves to straight hair. Referring to FIG. 2 and FIG. 3 in conjunction with FIG. 1, it will be understood that a person's hair 20 that is normally straight (FIG. 2) is woven between the cathode pegs 14 in the hair setting structure 12. This presets the hair 20. The hair 20 is treated in the manner previously described. That is, the hair 20 is coated in a buffered electrolyte 22 and is then exposed to hydrogen produced during electrolysis. Afterward, the hair 20 is neutralized in a non-caustic neutralizing solution or using the reversed current procedure previously explained. The hair 20 is then removed from the cathode pegs 14. The hair 20 now has the wavy body shown in FIG. 3, where the number of waves in the hair 20 corresponds to the number of cathode pegs 14 around which the hair 20 was woven. The waves in the hair 20 are just as permanent as waves created using prior art chemical perm techniques.

Figure 4:
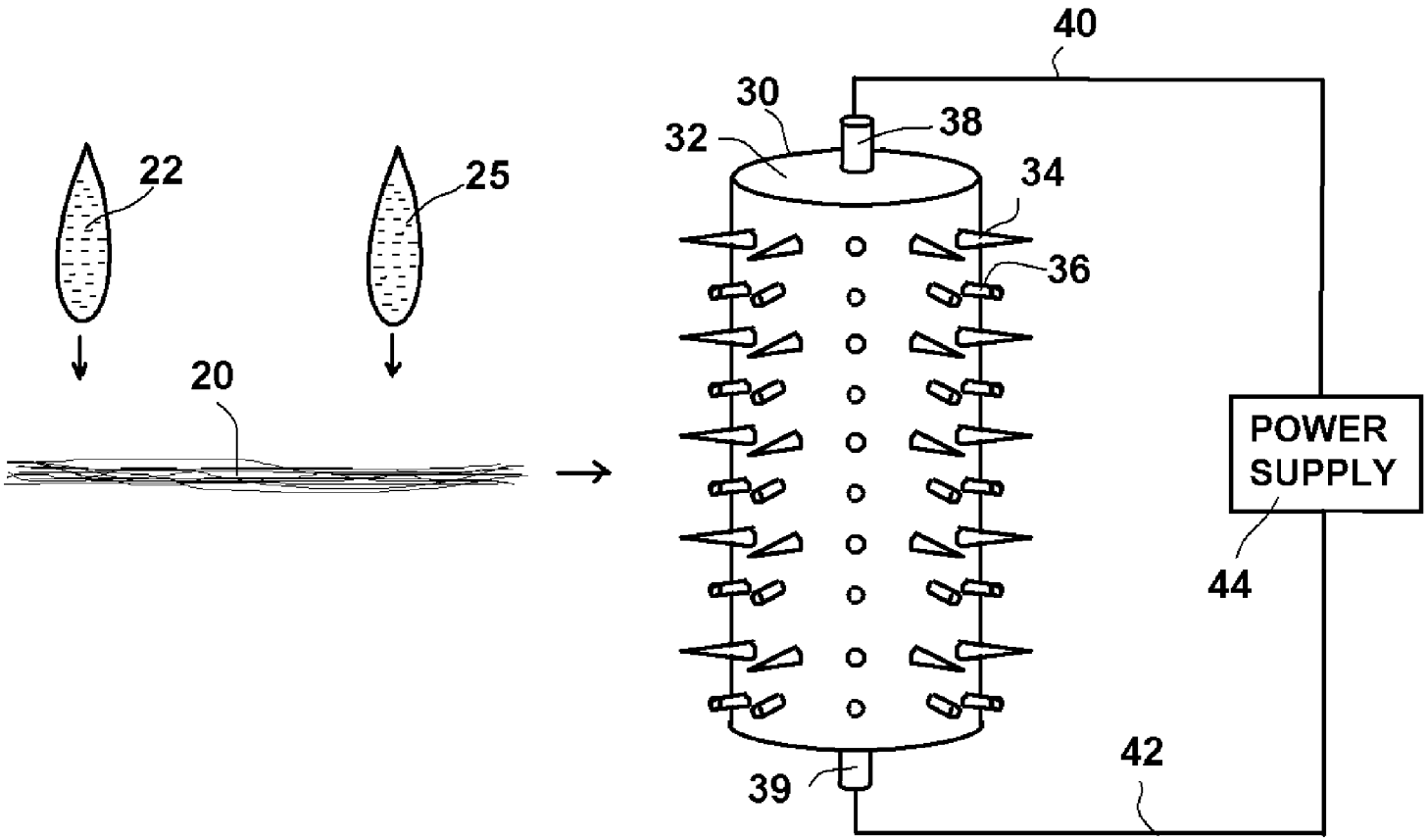
FIG. 4 shows a second exemplary embodiment of the present invention hair setting system.

Referring to FIG. 4, an alternate embodiment of the present invention is shown. In this embodiment, a hair curler setting structure 30 is shown. The hair curler setting structure 30 has a cylindrical body 32. A plurality of cathode pegs 34 and anode pegs 36 radially extend from the cylindrical body 32. The cathode pegs 34 and the anode pegs 36 are electrically insulated from one another. Two terminals 38, 39 extend from the ends of the hair curler setting structure 30. One terminal 38 is electrically coupled to the anode pegs 36. The opposite terminal 39 is connected to the cathode pegs 34. Leads 40, 42 from an external power supply 44 can be connected to the terminals 38, 39. In this manner, the cathode pegs 34 and the anode pegs 36 can be oppositely electrically charged.

Hair 20 is rolled about the hair curler setting structure 30 in the traditional manner. The hair 20 is then coated in a buffered electrolyte 22. The terminals 38, 39 of the hair roller setting structure 30 are then connected to the external power supply 44. The power supply 44 provides electrical power to the cathode pegs 34 and anode pegs 36. The electrical power induces electrolysis in the buffered electrolyte 22. The electrolysis produces hydrogen, which cleaves the disulfide bridges in the keratin proteins of the hair 20. After a while, the electrolysis is stopped and the hair 20 is neutralized by reversing the charge of the cathode pegs 34 and anode pegs 36 and/or utilizing another known hair-neutralizing agent 25 such as a dilute hydrogen peroxide. The hair is then permanently curled into the shape of the hair roller setting structure 30.

Figure 5:
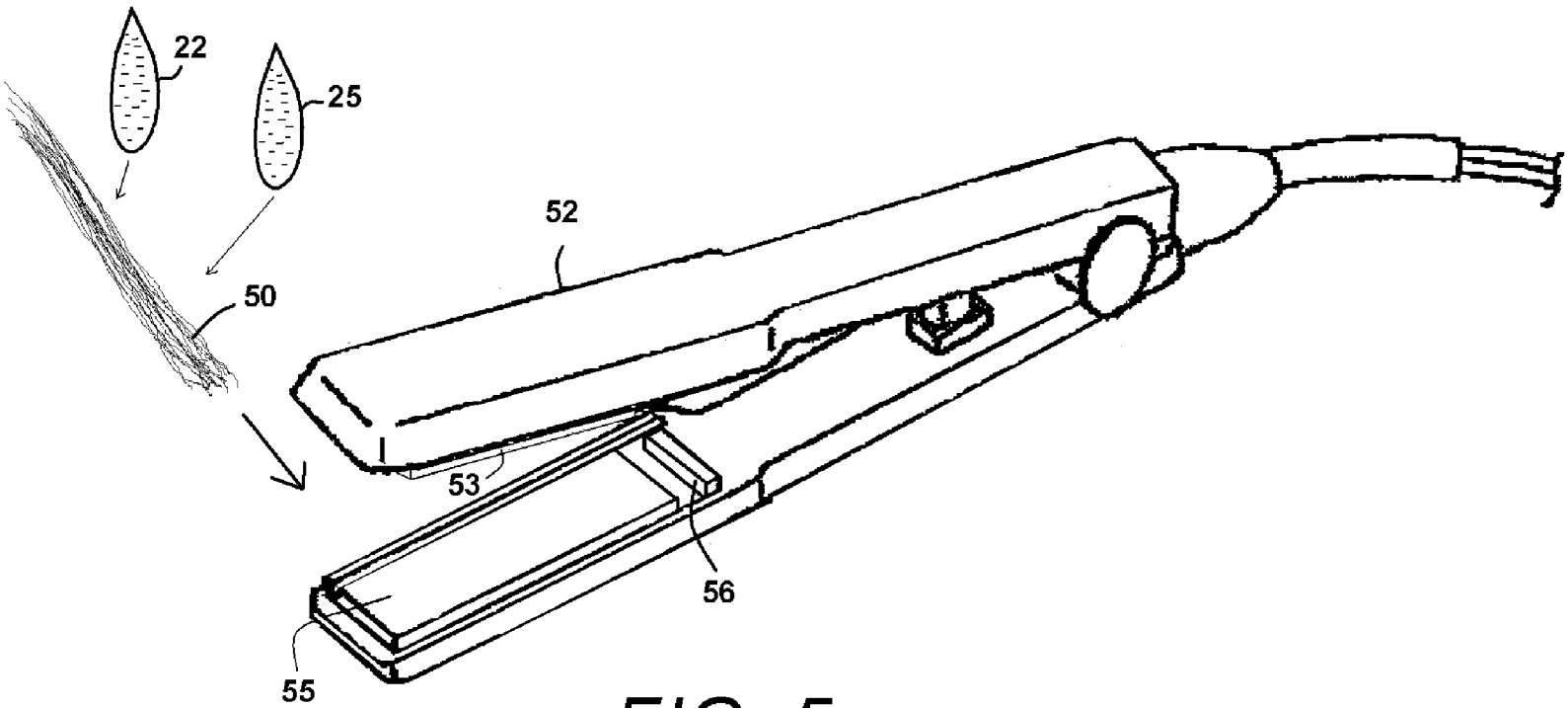
FIG. 5 shows a third exemplary embodiment of the present invention hair setting system.

In another adaptation of this invention, the electrolytic method can be used to straighten curly hair. Referring now to FIG. 5, a lock of curly hair 50 is shown. The curly hair 50 can be physically straightened using mechanical means and heat. For example, the curly hair 50 can be ironed flat using a hot iron or can be blown straight using a brush and a blow dryer. Once the hair 50 is physically straightened to a desired degree, the straightening of the hair 50 is made permanent using the present invention.

In FIG. 5, the hair setting structure is configured as a straightening iron 52. The hair 50 that has been physically straightened is only temporarily straightened. The physically straightened hair 50 is coated with a buffered electrolyte 22. The straightening iron 52 has two charged plates 53, 55. Each of the plates 53, 55 are cathodes and contact the hair 50 when the straightening iron 52 is closed upon the hair 50. An anode 56 is provided at a distal position. The anode 56 does not directly touch the hair 50 when the straightening iron 52 is closed, yet the anode 56 is close enough that it contacts the buttered electrolyte 22 that saturates the hair 50 and is squeezed from the hair 50 as the plates 53, 55 compress. The cathode plates 53, 56 and the anode 56 have an opposite electrical charge. When the hair 50 and buffered electrolyte 22 are sandwiched between the two plates 53, 53, electricity flows through the buffered electrolyte 22. This induces electrolysis in the buffered electrolyte 22. The electrolysis exposes the hair 50 to atomic hydrogen. The atomic hydrogen cleaves the disulfide bonds and leaves the shape of the hair 50 amenable to reshaping. The hair 50 is then neutralized. This can be done by reversing the charge of the cathode and anode, as has been previously explained. Alternatively, the plates 53, 55 can be removed and the hair 50 combed or brushed straight using a neutralizing rinse. The rinse enables the disulfide bonds to reform. The result is now that the hair 50 has been straightened or "relaxed" without the use of any harsh alkalis or other caustic, foul smelling reducing chemicals.

In all of the embodiments described, a buffered electrolyte 22 is used to saturate the hair prior to electrolysis. The buffered electrolyte is preferably a water-based gel that is buffered with an electrolyte to have a pH of between 4 and 10, with a pH of 8 being preferred. In all of the embodiments described, the current provided to the cathode and anode is a direct current having a voltage of at least 1.2 volts in order to induce electrolysis.

It will be understood that the embodiments of the present invention that are illustrated and described are merely exemplary and that a person skilled in the art can make many variations to those embodiments. For instance, many different configurations of cathode pegs and anode pegs can be used on a variety of flat and curved surfaces. All such embodiments are intended to be included within the scope of the present invention as defined by the claims.

What is claimed is:

1. A method of changing the shape of hair, comprising the steps of:

providing an electrically conductive medium that contains water;

providing at least one cathode and at least one anode, wherein said at least one cathode and said at least one anode have an opposite charge;

setting said hair into a predetermined shape, wherein at least some of said hair lay proximate to said at least one cathode;

wetting said hair with said electrically conductive medium;

inducing electrolysis in said electrically conductive medium by flowing electrical current between said at least one cathode and said at least one anode; and neutralizing said hair by reversing said opposite charge between said at least one cathode and said at least one anode for a period of time.

2. The method according to claim 1, further including the step of stopping said electrolysis after said predetermined period of time.

3. The method according to claim 2, further including the step of removing said electrically conductive medium and neutralizing said hair with a neutralizing agent.

4. The method according to claim 3, wherein said neutralizing agent is a medium containing hydrogen peroxide.

5. The method according to claim 1, wherein said step of providing an electrically conductive medium that contains water includes providing a viscous gel.

6. The method according to claim 1, wherein said step of providing at least one cathode and at least one anode includes providing a hair setting structure having a plurality of cathode pegs and a plurality of anode pegs extending therefrom.

7. The method according to claim 6, wherein said step of setting said hair into a predetermined shape includes weaving said hair between said plurality of cathode pegs.

8. The method according to claim 6, wherein said hair setting structure is configured as a hair curler.

9. The method according to claim 8, wherein said step of setting said hair into a predetermined shape includes rolling said hair around said hair curler.

10. The step according to claim 1, further including the step of physically straightening said hair with heat prior to said step of wetting said hair with said electrically conductive medium.

11. A method of setting a wave pattern into straight hair, comprising the steps of:

providing an electrically conductive medium that contains water;

providing a setting structure that has at least one cathode and at least one anode, wherein said at least one cathode and said at least one anode have an opposite charge;

setting said hair into said wave pattern on said setting structure, wherein at least some of said hair lay proximate to said at least one cathode;

wetting said hair with said electrically conductive medium;

inducing electrolysis in said electrically conductive medium by flowing electrical current between said at least one cathode and said at least one anode; and neutralizing said hair by reversing said opposite charge between said at least one cathode and said at least one anode.

12. The method according to claim 11, further including the step of stopping said electrolysis after a predetermined period of time.

13. The method according to claim 12, further including the step of removing said electrically conductive medium and neutralizing said hair with a neutralizing agent.

14. The method according to claim 11, wherein said step of providing at least one cathode and at least one anode includes providing said setting structure with a plurality of cathode pegs and a plurality of anode pegs extending therefrom, wherein said step of setting said hair into said wave pattern includes weaving said hair into said wave pattern among said plurality of cathode pegs.

15. The method according to claim 14, further including the step of stopping said electrolysis after a predetermined period of time.

16. The method according to claim 15, further including the step of neutralizing said hair with a chemical neutralizing agent.

17. A method of straightening hair, comprising the steps of:

physically straightening said hair;

providing an electrically conductive medium that contains water;

wetting said hair with said electrically conductive medium;

inducing electrolysis in said electrically conductive medium by flowing electrical current through said electrically conductive medium between a cathode and an anode of opposite charge; and neutralizing said hair by momentarily reversing said opposite charge between said cathode and said anode.

* * * * *